US006832870B1

(12) United States Patent
Krivoy

(10) Patent No.: US 6,832,870 B1
(45) Date of Patent: Dec. 21, 2004

(54) BARRIER TRANSPORTER AND POSITIONER

(76) Inventor: Paul Jules Krivoy, Rte. 3, Box 208W, Corpus Christi, TX (US) 78415

( * ) Notice: Subject to any disclaimer, the term of this patent is extended or adjusted under 35 U.S.C. 154(b) by 85 days.

(21) Appl. No.: 10/146,613

(22) Filed: May 15, 2002

(51) Int. Cl.[7] ..... E01F 13/00
(52) U.S. Cl. ..... 404/6; 404/9; 414/458
(58) Field of Search ..... 414/495, 458, 414/459; 404/6, 9

(56) References Cited

U.S. PATENT DOCUMENTS

| | | | | | |
|---|---|---|---|---|---|
| 3,759,409 | A | * | 9/1973 | Wenzel et al. | 414/460 |
| 3,973,754 | A | * | 8/1976 | Chadwick, Jr. | 254/323 |
| 4,231,709 | A | * | 11/1980 | Corsetti | 414/458 |
| 4,491,452 | A | * | 1/1985 | Matovich | 414/427 |
| 4,600,178 | A | * | 7/1986 | Zucker et al. | 256/1 |
| 4,632,598 | A | * | 12/1986 | Richards | 404/6 |
| 4,936,733 | A | * | 6/1990 | Girerd | 414/458 |
| 5,007,763 | A | * | 4/1991 | Burgett | 404/6 |
| 5,088,874 | A | * | 2/1992 | Quittner | 414/460 |
| 5,800,114 | A | * | 9/1998 | Secondi | 414/458 |
| 5,885,048 | A | * | 3/1999 | Barth | 414/495 |
| 6,450,522 | B1 | * | 9/2002 | Yamada et al. | 280/414.5 |

FOREIGN PATENT DOCUMENTS

| | | | |
|---|---|---|---|
| EP | 605 976 | * | 7/1994 |

* cited by examiner

*Primary Examiner*—Thomas J. Brahan
(74) *Attorney, Agent, or Firm*—George S. Gray

(57) ABSTRACT

An apparatus for transporting and positioning traffic barriers, where the positioning includes lift assemblies for lowering an elevator structure bearing the barrier from a raised position during transport to a lower position on the ground surface once the apparatus has been rolled to the desired position of the barrier. Manual and automatic lift, steering, and driving assemblies are provided.

33 Claims, 14 Drawing Sheets

BARRIER TRANSPORTER AND POSITIONER

BACKGROUND OF THE INVENTION

1. Field of the Invention

The field of the invention is traffic barriers, or, more specifically, movable traffic barriers.

2. Description of Related Art

For security reasons, many government and private organizations desire to control automotive traffic into their facilities through gates, entrances and the like. Typically, these organizations transport heavy, solid traffic barriers using forklifts and other heavy equipment. In other instances, water-filled barriers are used so that the barriers are lighter during transport due to lack of water in the barrier until it is later added after the barrier is positioned.

In some instances electric gates are provided that allow rapid opening and closing of an entrance, however, these are cantilevered or wheeled, thus significantly reducing resistance to automobile or truck impact.

It is a significant drain on time and the workforce to have heavy equipment involved when barriers must be moved or installed. Similarly, refilling water-filled barriers is time consuming and labor intensive.

These problems are amplified when a row of barriers is desired to block access to large facility items such as a ship in dock, etc.

What is needed is an apparatus that provides for rapid, rolling transport of a heavy barrier into a desired security position and then provides a rapid ability to position the barrier on the ground for maximum impact resistance. The apparatus should be readily operated by one user without the need for forklifts or heavy equipment, and the apparatus should transport water-filled barriers without the need to drain the barrier.

SUMMARY OF THE INVENTION

My invention provides an apparatus for the rapid, rolling transport of a heavy barrier, including water-filled barriers, and also provides for the rapid placement of the barrier on the ground surface when in the desired position The apparatus is operable by a single user without the need for forklifts or heavy equipment. Subsequent relocation of the barrier is accomplished rapidly, even in a gate open-close environment requiring frequent repositioning of the barrier.

In various embodiments of my invention, the barrier is received by a wheeled elevator structure and lift assemblies for raising and lowering the elevator structure, such that the barrier received by the elevator structure is also raised and lowered. While raised the apparatus can be rolled and steered to a desired barrier position. When in the desired location the lift assemblies lower the elevator structure to its lowest position such that the barrier's weight is off the wheels and on the ground surface.

My invention provides an apparatus for transporting and positioning a barrier on a surface, the barrier having a first end, second end, a front side, a rear side, a top portion, and a bottom portion having a lower surface, the bottom portion being substantially wider than the top portion when viewed from the barrier first and second ends, the apparatus comprising: an elevator adapted to receive the barrier, the elevator having a base, the barrier bottom portion lower surface being positioned on the base, a first end and a second end, a first upright member having a top, a second upright member having a top, and a connection member for connecting the first unright member top and the second upright member top, the first upright member having a width substantially the same as or less than the barrier top portion first end, the second upright member having a width substantially the same as or less than the barrier top) portion second end, and the connection member having a width substantially the same as or less than the barrier top portion, the first and second upright members and the connection member being positioned proximate the barrier first and second ends and top portion, respectively, such that the barrier front side and the barrier rear side are viewable without substantial obstruction from the first upright member, second unright member and the connection member; a first wheel assembly having at least two wheel members and a second wheel assembly having at least two wheel members; and a first lift assembly positioned proximate the elevator first end and cooperating with the first wheel assembly for raising and lowering the elevator first end, and a second lift assembly positioned proximate the elevator second end and cooperating with the second wheel assembly for raising and lowering the elevator second end, the barrier being raised and lowered with the elevator.

In one exemplary embodiment the elevator provides lateral support for the barrier.

In one exemplary embodiment the apparatus further comprises a powered hydraulic system for simultaneously operating the first and second lift assemblies, the first and second lift assemblies each comprising a hydraulic cylinder.

In one exemplary embodiment at least one of the first and second lift assemblies comprises a single acting hydraulic cylinder.

In one exemplary embodiment at least one of the first and second lift assemblies comprises a double acting hydraulic cylinder.

In one exemplary embodiment both the first and second lift assemblies comprise double acting hydraulic cylinders and the cylinders are positioned such that the first and second wheel assemblies are elevated above the surface after the elevator is lowered to the elevator's lowest position.

In one exemplary embodiment the apparatus further comprises a controller for operating the powered hydraulic system.

In one exemplary embodiment the controller is detachable.

In one exemplary embodiment the apparatus further comprises a powered system for simultaneously operating the first and second lift assemblies, the first and second lift assemblies each comprising a powered lift mechanism.

In one exemplary embodiment the apparatus further comprises a controller for operating the powered system.

In one exemplary embodiment the controller is detachable.

In one exemplary embodiment the apparatus further comprises a remote controller.

In one exemplary embodiment the first lift assembly comprises a first manual jack and the second lift assembly comprises a second manual jack.

In one exemplary embodiment the first and second manual jacks are positioned such that the first and second wheel assemblies are elevated above the surface after the elevator is lowered to the elevator's lowest position.

In one exemplary embodiment the first lift assembly comprises a first hydraulic jack and the second lift assembly comprises a second hydraulic jack.

In one exemplary embodiment the first and second hydraulic jacks are in hydraulic communication for simultaneous lifting.

In one exemplary embodiment the apparatus further comprises a steering assembly for turning the apparatus.

In one exemplary embodiment the steering assembly comprises a powered hydraulic system having a double-acting hydraulic cylinder, the cylinder having a rod, and a steering linkage assembly for linking the hydraulic cylinder to one of the first wheel assembly wheel members and linking the one wheel member to the other first wheel assembly wheel member for simultaneous steer-turning in response to extension and retraction of the rod from and into the hydraulic cylinder.

In one exemplary embodiment the steering assembly comprises: a pivot member for each first wheel assembly wheel member, each wheel member steer-turning in response to movement of the pivot member; a shaft member, the handle member being attached to the first wheel assembly for pivoting; and a link member for linking the handle member and wheel pivot members, such that both wheel member pivot arms move in response to pivoting motion of the shaft.

In one exemplary embodiment the apparatus further comprises a powered driving assembly for driving the apparatus.

In one exemplary embodiment the apparatus further comprises a powered driving assembly for driving the apparatus by rotating at least one of the second wheel assembly wheel members.

In one exemplary embodiment the driving assembly comprises a powered hydraulic system having a hydraulic driving assembly on the at least one wheel member.

In one exemplary embodiment the apparatus further comprises a hydraulic brake.

In one exemplary embodiment the apparatus further comprises a brake.

There is provided herein an apparatus for transporting and positioning a barrier on a surface, the barrier having a first end, second end, a front side, a rear side, a top portion, and a bottom portion having a lower surface, the bottom portion being substantially wider than the top portion when viewed from the barrier first and second ends, the apparatus comprising: an elevator adapted to receive the barrier, the elevator having a base, the barrier bottom portion lower surface being positioned on the base, a first end and a second end, a first upright member having a top, a second upright member having a top, and a connection member for connecting the first upright member top and the second upright member top, the first upright member having a width substantially the same as or less than the barrier top portion first end, the second upright member having a width substantially the same as or less than the barrier top portion second end, and the connection member having a width substantially the same as or less than the barrier top portion, the first and second upright members and the connection member being positioned proximate the barrier first and second ends and top portion, respectively, such that the barrier front side and the barrier rear side are viewable without substantial obstruction from the first unright member, second upright member and the connection member; a first wheel assembly having at least two wheel members and a second wheel assembly having at least two wheel members, the first wheel assembly positioned proximate the elevator first end, the second wheel assembly positioned proximate the elevator second end; and elevating means for raising and lowering the elevator with respect to the first and second wheel assemblies, the barrier being raised and lowered with the elevator.

In one exemplary embodiment the elevating means comprises a first manual jack proximate the first wheel assembly and a second manual jack proximate the second wheel assembly.

In one exemplary embodiment the elevating means comprises a first hydraulic jack proximate the first wheel assembly and a second hydraulic jack proximate the second wheel assembly.

In one exemplary embodiment the elevating means comprises a powered hydraulic system comprising a first hydraulic cylinder proximate the first wheel assembly and a second hydraulic cylinder proximate the second wheel assembly.

In one exemplary embodiment the elevating means comprises a powered system comprising a first powered lifting mechanism proximate the first wheel assembly and a second powered lifting mechanism proximate the second wheel assembly.

In one exemplary embodiment the apparatus further comprises means for driving the apparatus.

In one exemplary embodiment the apparatus further comprises means for steering the apparatus.

In one exemplary embodiment the apparatus further comprises means for braking the apparatus.

I have provided in my invention, an apparatus for transporting and positioning a barrier on a surface, the barrier having a first end, second end, a front side, a rear side, a top portion, and a bottom portion having a lower surface, the bottom portion being substantially wider than the top portion when viewed from the barrier first and second ends the apparatus comprising: an elevator adapted to receive the barrier, the elevator having a base, the barrier bottom portion lower surface being positioned on the base, a first end and a second end, a first upright member having a top, a second upright member having a top, and a connection member for connecting the first upright member top and the second upright member top, the first upright member having a width substantially the same as or less than the barrier top portion first end, the second upright member having a width substantially the same as or less than the barrier top portion second end, and the connection member having a width substantially the same as or less than the barrier top portion, the first and second upright members and the connection member being positioned proximate the barrier first and second ends and top portion, respectively, such that the barrier front side and the barrier rear side are viewable without substantial obstruction from the first upright member, second upright member and the connection member; a first wheel assembly having at least two wheel members and a second wheel assembly having at least two wheel members; and a first lift assembly positioned proximate the elevator first end and cooperating with the first wheel assembly for raising and lowering the elevator first end, and a second lift assembly positioned proximate the elevator second end and cooperating with the second wheel assembly for raising and lowering the elevator second end, the barrier being raised and lowered with the elevator; and further wherein the elevator provides lateral support for the barrier; and the apparatus further comprises: a powered hydraulic system for simultaneously operating the first and second lift assemblies, the first and second lift assemblies each comprising a doublet-acting hydraulic cylinder, the cylinders being positioned such that the first and second wheel assemblies are elevated above the surface after the elevator is lowered to the elevator's lowest position; a controller for operating the powered hydraulic system; a powered steering assembly for turning the first wheel assembly wheel members, the steering assembly being powered by the powered hydraulic system; and a powered driving assembly for turning the second wheel assembly wheel members, the driving assembly being powered by the powered hydraulic system.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION OF EXEMPLARY EMBODIMENTS

Introduction

The present invention is described to a large extent in this specification in connection with conventional water-filled barriers traffic barriers that are drainable and refillable to assist in transport. Persons skilled in the art, however, will recognize that any barrier material or construction having similar shape and function also falls well within the scope of the present invention, including without limitation, concrete and metal barriers.

Detailed Description

Figure 1:
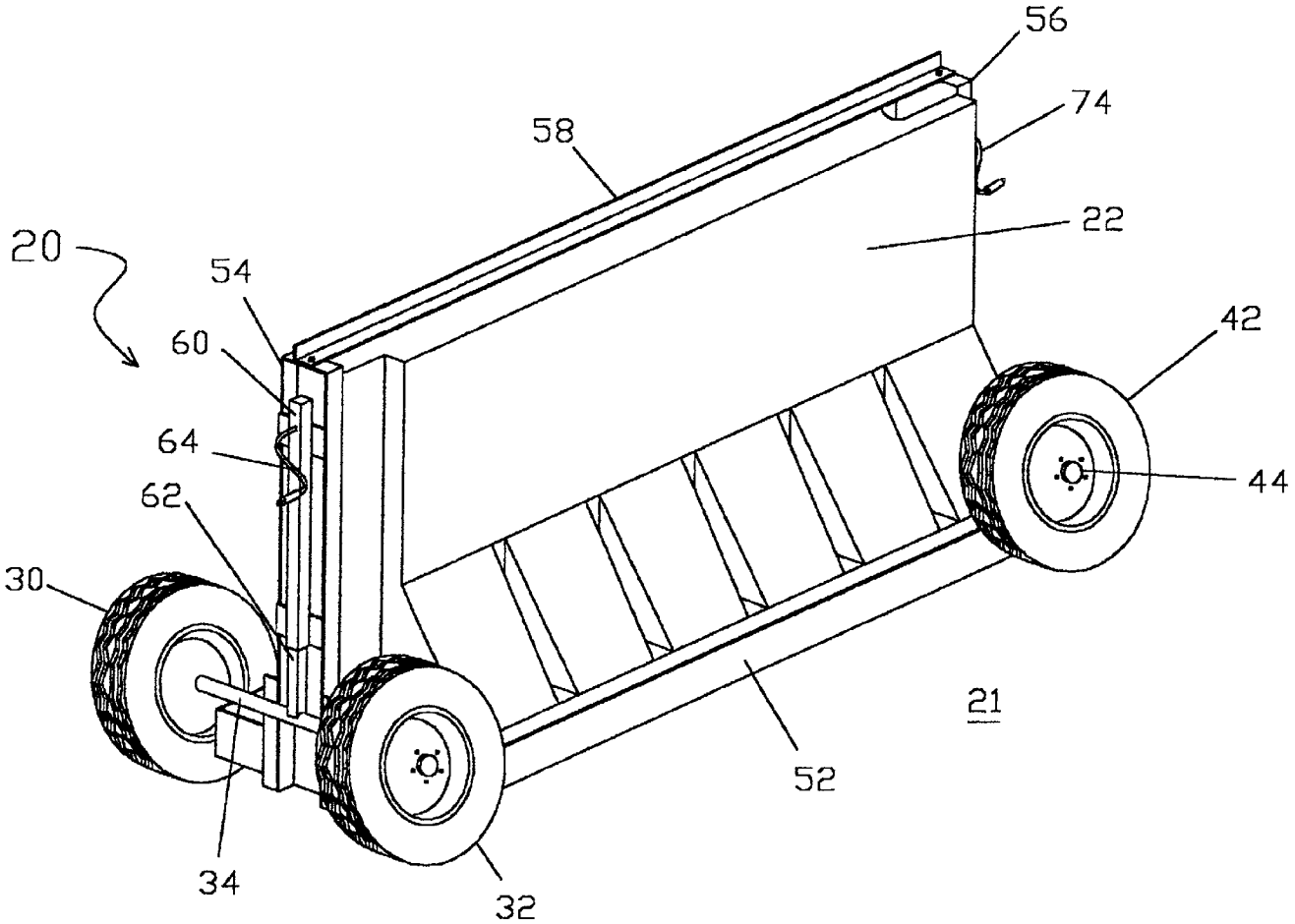
FIG. 1 is an oblique view of an exemplary embodiment of the present invention having manual lift assemblies. The barrier is in position on the elevator structure.
Figure 2:
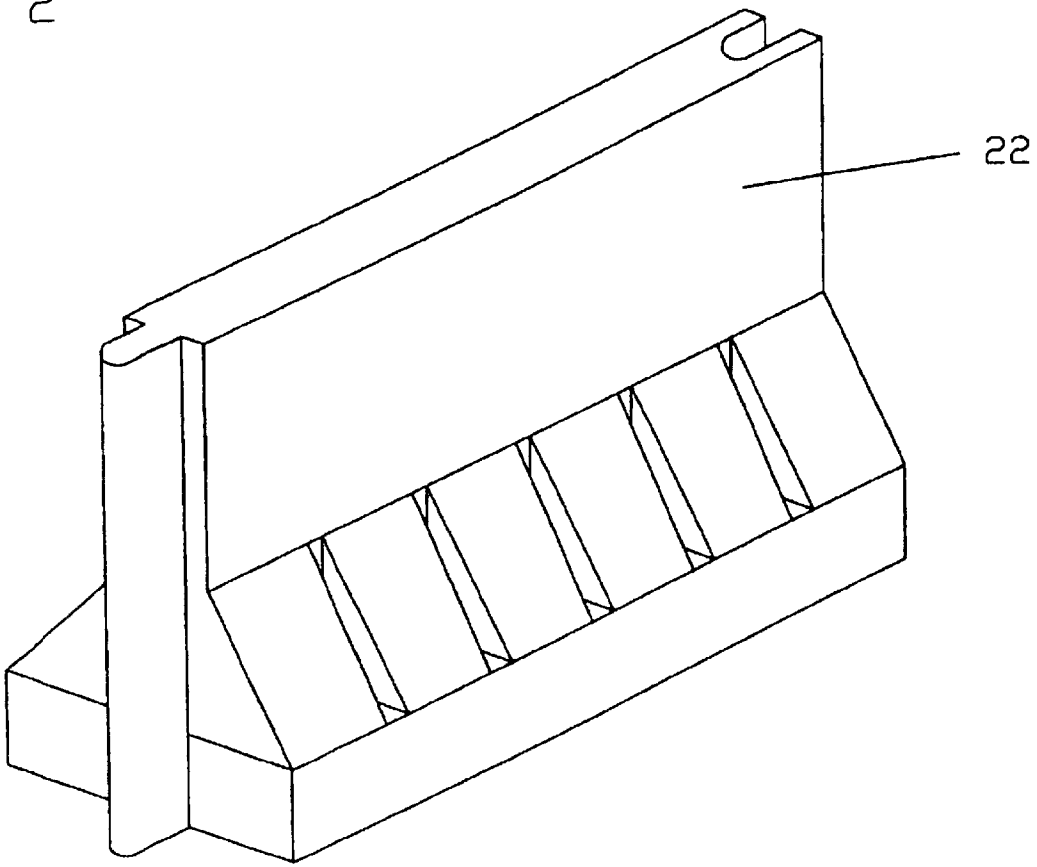
PRIOR ART FIG. 2
FIG. 2 is an oblique view of a conventional water-filled barrier.

As shown in FIGS. 1–6, an exemplary embodiment of my invention provides transport and positioning for a barrier 22 on a surface 21. The barrier 22 shown is of a conventional water-filled type, as shown in FIG. 2. These typically interlock at the ends to form barrier rows, although many installations include single barrier applications for blocking a gate, road or entrance.

Figure 3:
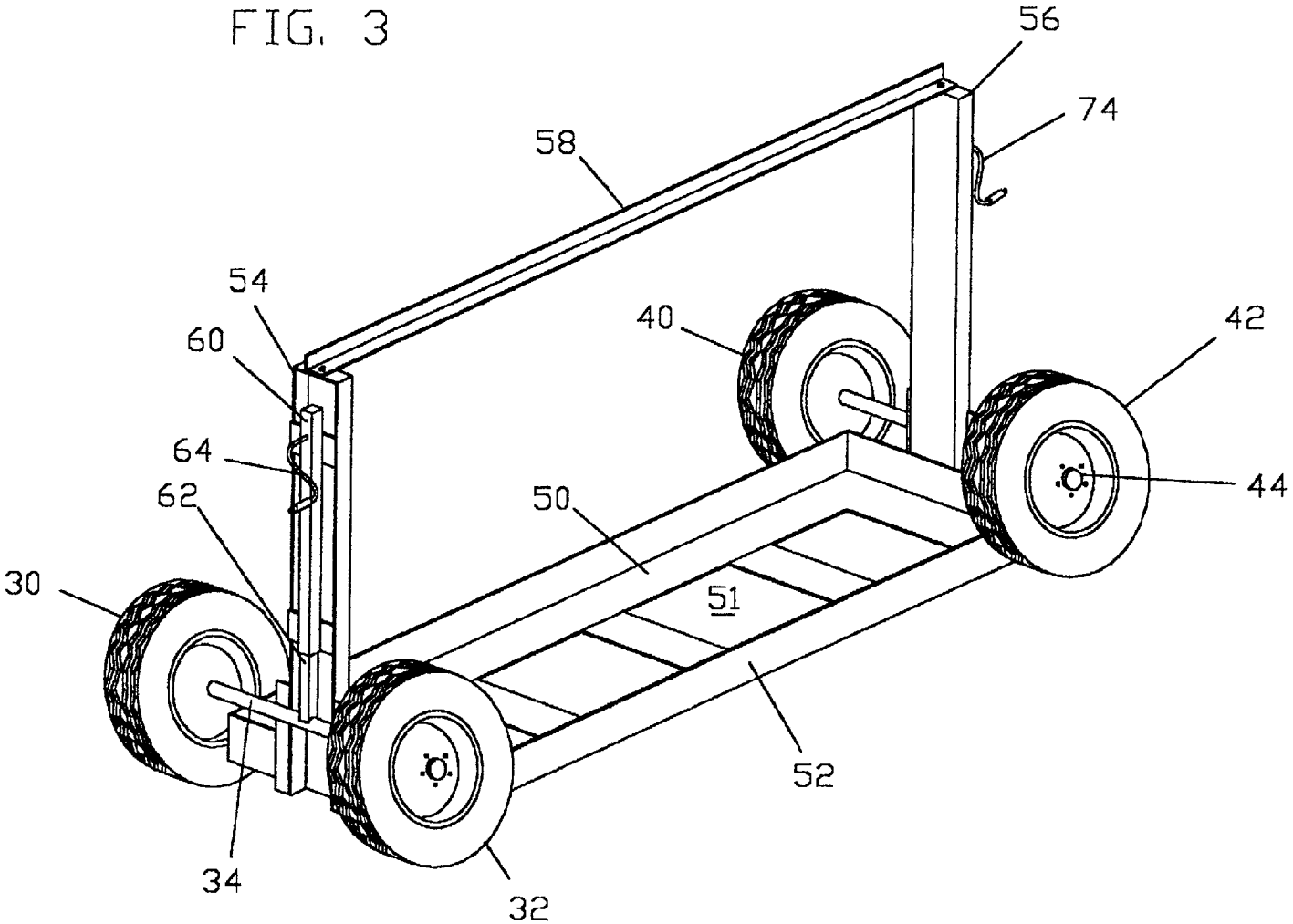
FIG. 3 is an oblique view of an exemplary embodiment of the present invention with the barrier removed.
Figure 4:
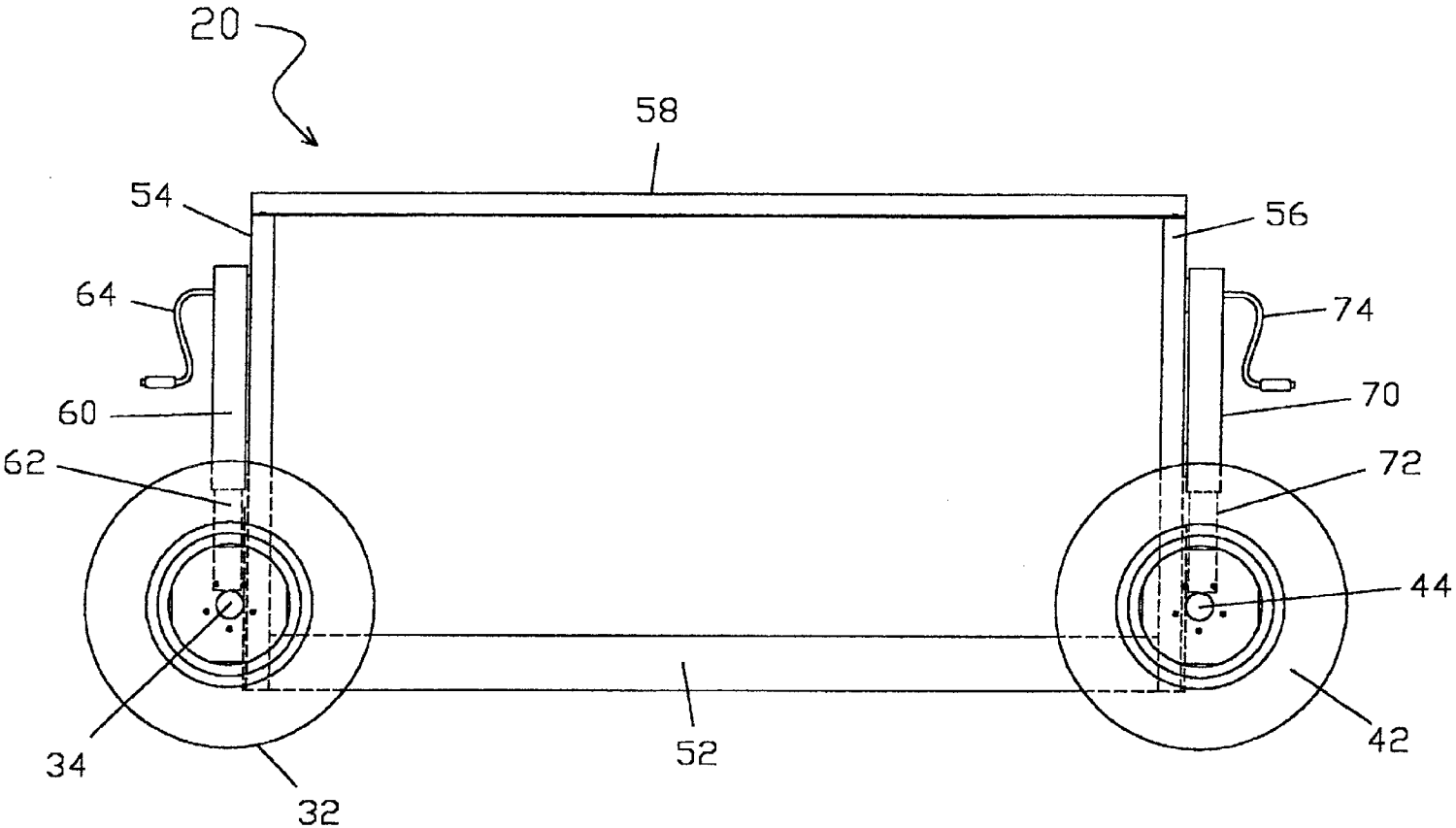
FIG. 4 is a side view of an exemplary embodiment of the present invention with the barrier removed.

The barrier 22 is removed from FIG. 3, wherein an exemplary embodiment of the apparatus 20 is shown to include a first wheel assembly with two wheels 30,32 and an axle structure 34 that connects the wheels. Similarly, a second wheel assembly includes two wheels 40,42 and an axle structure 44 that connects these wheels. In other embodiments, one or more additional wheels are included in the first and/or second wheel assemblies.

As shown in FIG. 3, an elevator structure 50 is positioned between the first and second wheel assemblies. The elevator structure 50 includes the base with openings 51 and sides 52. In this exemplary embodiment, the sides 52 encapsulate the lower portion of the barrier 22, and as shown in FIG. 1, thus provide lateral support for the barrier.

Attached to the first end of the elevator structure 50 and sides 52 is an upright post-like member 54, with a similar member 56 on the second end of the elevator structure. The upright members 54,56 are attached by a cross member 58. In some embodiments, the elevator structure includes angle iron with four inch sides 52 and the upright members 54,56 are made from with iron and boxed on one side with braces on the open side. In other embodiments, the elevator structure includes side-less elevator structure.

As shown in FIG. 1 the upright members 54,56 have top portions that have widths that are substantially the same as or less than the narrower top portion of the barrier 22 ends. The cross member 58 that connects the upright members also has a width that is less than the width of the top portion of the barrier. In another exemplary embodiment, the cross member is substantially the same as the width of the barrier top portion. With the upright members and the cross member sized in this manner, the upright members and the cross members do not substantially obstruct the view of the front or rear sides of the barrier.

As shown in FIG. 3, the elevator structure 50 has a base upon which the lower surface of the barrier bottom portion is shown to be positioned in FIG. 1.

A similar arrangement is present on the second end for a second lift assembly where a manual jack telescoping portion 70 telescopes over a manual jack telescoped portion 72 in response to manual cranking of the jack handle 74. The telescoping portion is attached to the upright member 56 and the telescoped portion 72 is attached to the second wheel assembly axle structure 44. During coordinated rotation (simultaneous are alternating) of both handles 64,74 the telescoping portions are forced upwardly thus raising the upright members 54,56 and the elevator structure 50. As shown clearly in FIG. 5, this coordinated cranking displaces the elevator structure from the surface 21 and the wheels are free to turn as the apparatus 20 is pushed or pulled.

Figure 6:
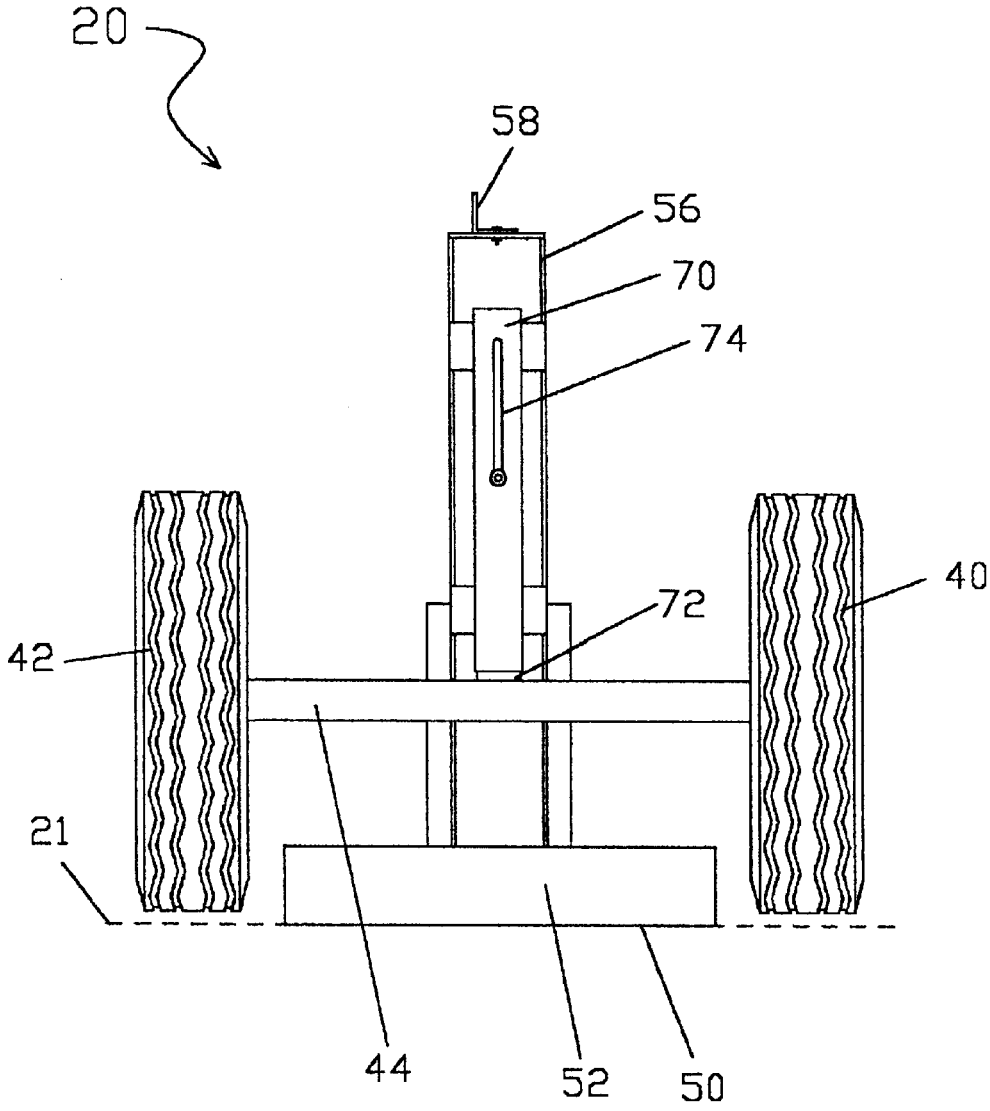
FIG. 6 is an end view of an exemplary embodiment of the present invention with the barrier removed and the elevator structure in the down position with the wheels jacked off the ground.

Conversely, and as shown in FIG. 6, if the coordinated rotation of jack handles 64,74 is reversed the elevator structure 50 is lowered to the surface 21. Continued cranking in this direction, after the elevator structure is on the surface, will elevate the wheels 30,32,40,42 from the ground surface 21. This assures that the full weight of the barrier 22 is being borne by the surface, avoids damage to the tires caused by long term, static contact with the surface, which may be dirt with moisture, and also makes it simpler to attach protective wheel coverings. The appearance also suggests a "permanent" placement of the barrier to an observer and facilitates easy removal of the wheels, if desired.

Figure 5:
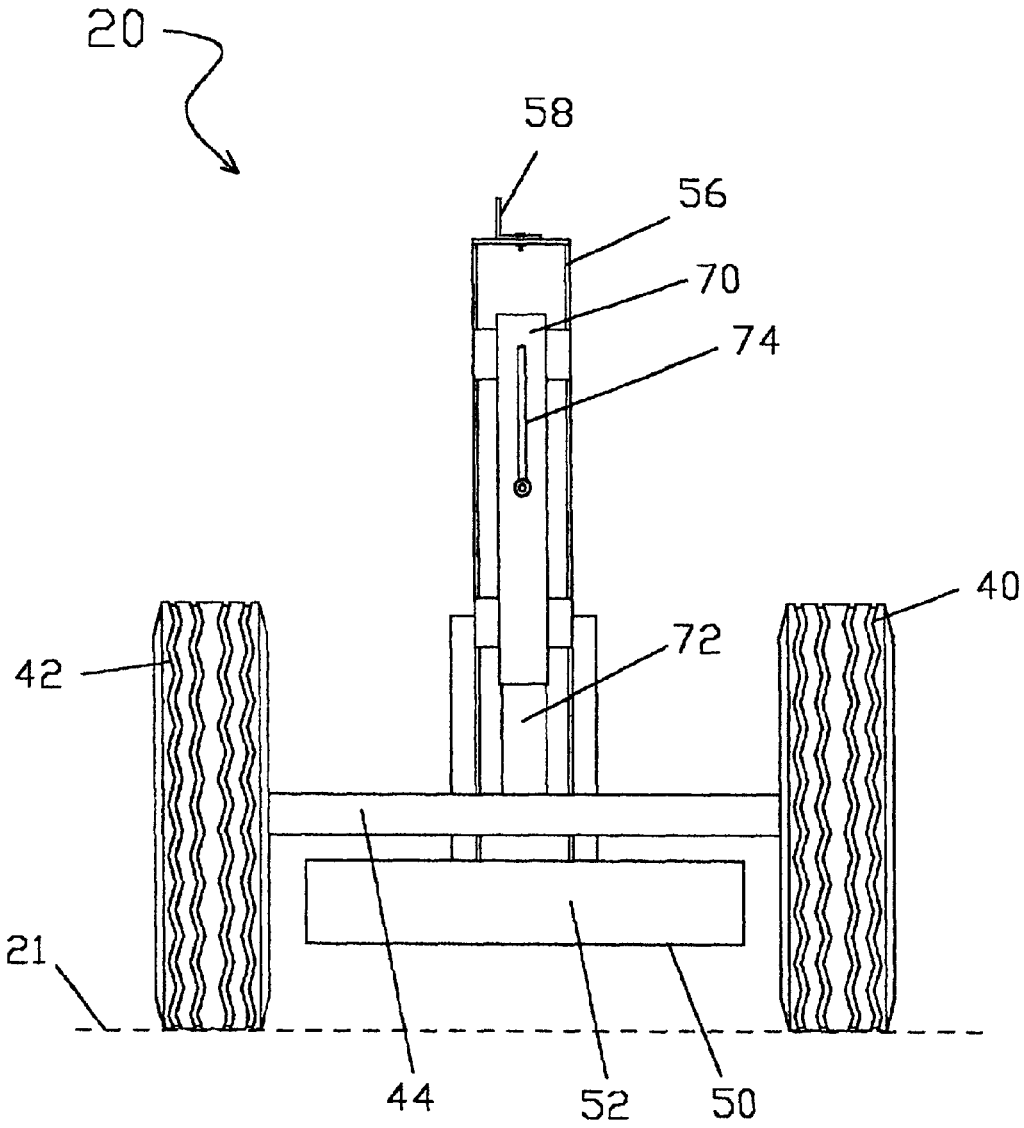
FIG. 5 is an end view of an exemplary embodiment of the present invention with the barrier removed and the elevator structure in a raised position.

The manual jacks are conventional mechanical jacks for which several known types will suffice. As shown in FIG. 5 and FIG. 6, however, the amount of jack travel must be sufficient to allow the elevator structure 50 to descend to its lowest position. In some embodiments, the jack travel is limited to the length necessary for the elevator structure to reach the lowest position. In others, such as the type of embodiments shown in FIG. 5 and FIG. 6, additional travel allows the wheels to be elevated above the ground.

Figure 7:
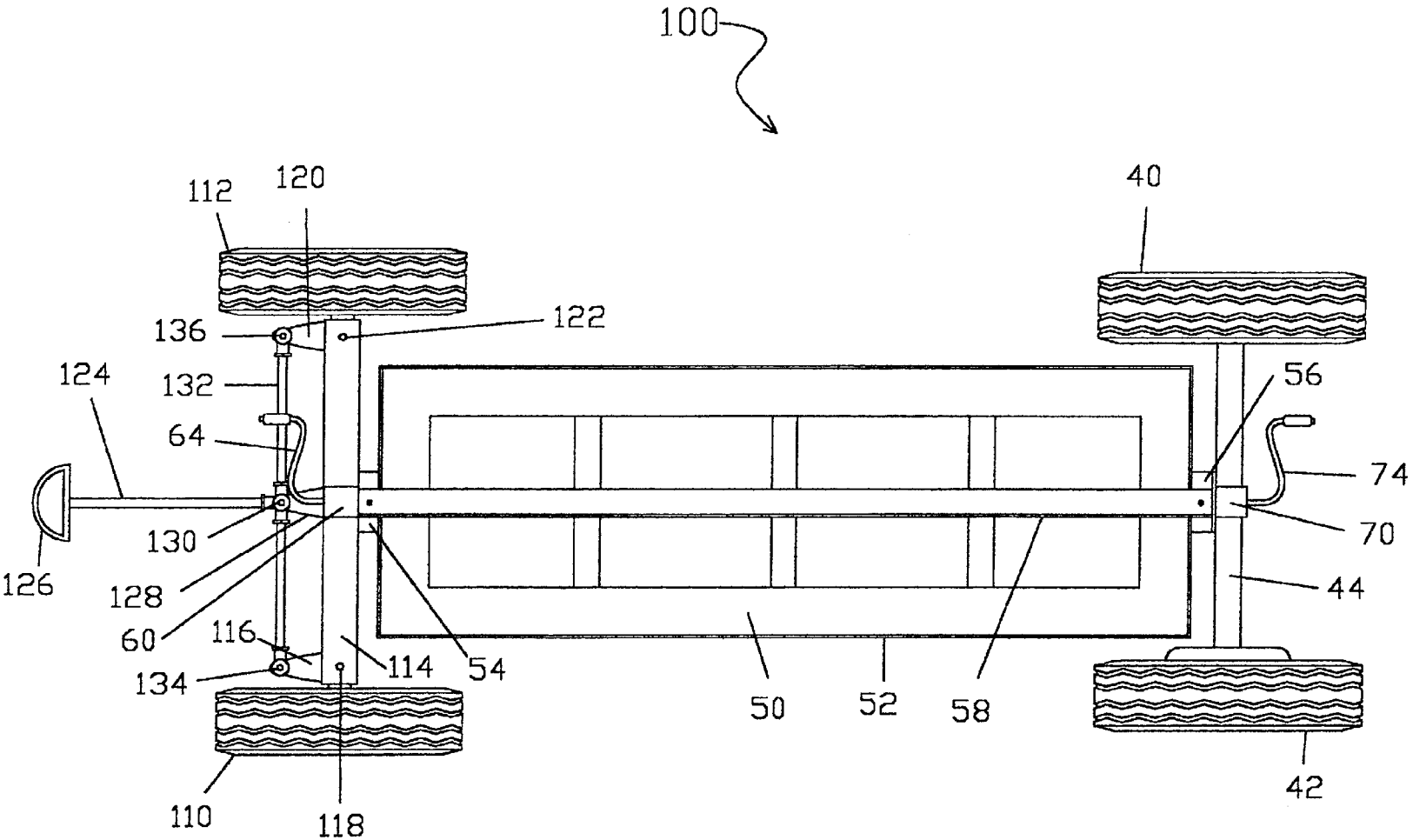
FIG. 7 is a top view of an exemplary embodiment of the present invention with the barrier removed and a manual steering assembly included.
Figure 8:
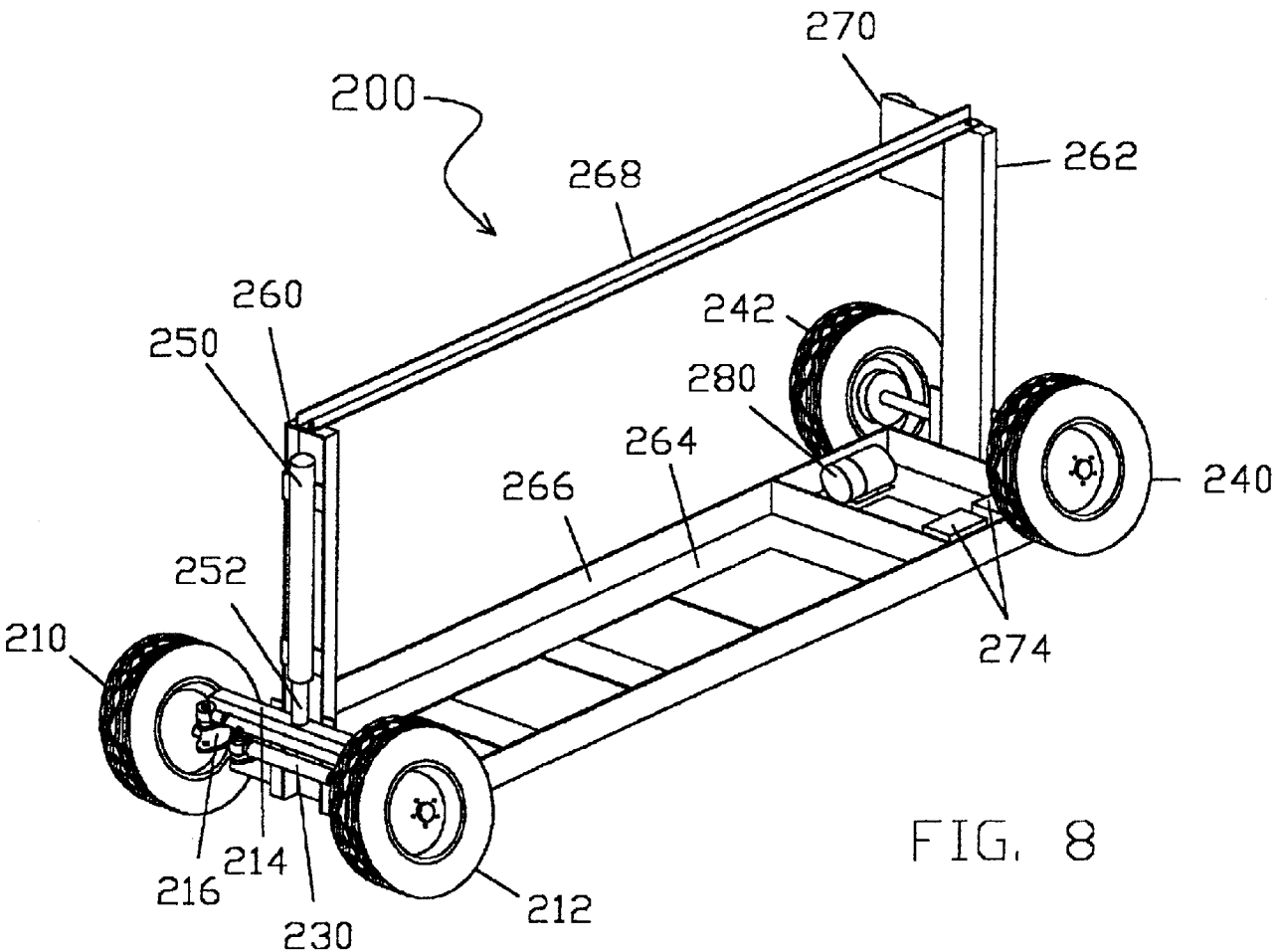
FIG. 8 is an oblique view of an exemplary embodiment of the present invention with the barrier removed and selected components of a powered hydraulic system shown representatively.

With reference to FIG. 7, an additional exemplary embodiment of the apparatus 100 is shown to include a modified first wheel assembly with the two wheels 110,112 being attached for pivoting in steering fashion on an axle structure 114. The first wheel 10 is attached to a pivot member 116 that is pivotably attached to the axle structure on a pivot pin 118. Similarly, the second wheel 112 is attached to a pivot member 120 that is pivotably attached to the axle structure on a pivot pin 122. A steering shaft 124 with a handle 126 is pivotably attached to the axle structure with a similar pivot pin (not shown).

As shown in FIG. 7, this embodiment has a tie-rod assembly 132 attached to the steering shaft 124 on a pivot pin 130. The steering shaft is attached to the first wheel's pivot member 116 on a pivot pin 134, and attached to the second wheel's pivot member 120 on a pivot pin 136. The rigid tie-rod assembly moves left and right toward the wheels 110,112 as the steering shaft moves left and right. This tie-rod movement causes simultaneous movement of the pivot members 116,120 in the same direction, thus steering the apparatus 100 left and right in response to the left and right steering shaft 124 movements.

Figure 9:
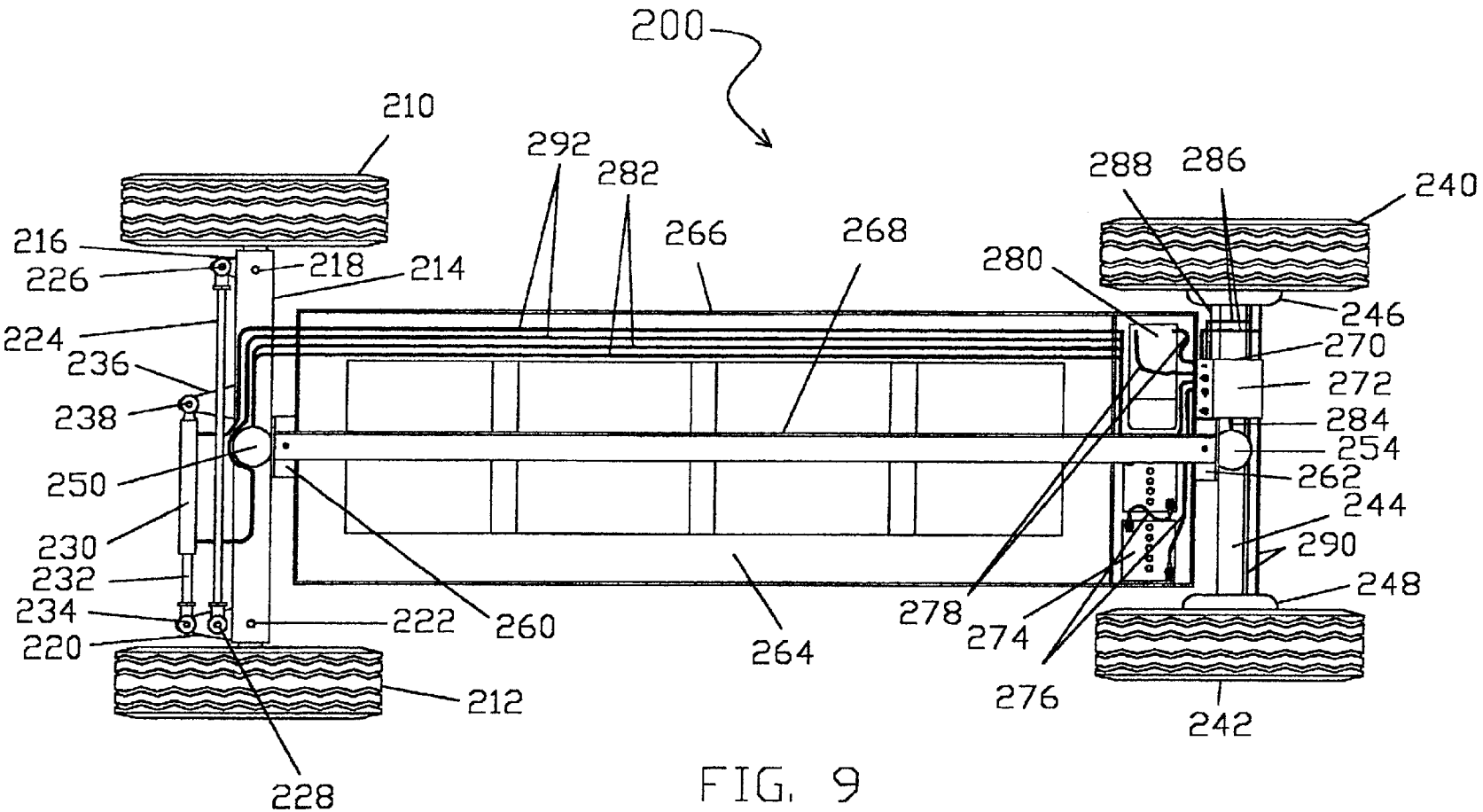
FIG. 9 is a top view of an exemplary embodiment of the present invention with the barrier removed and a powered hydraulic system shown, with hydraulic line routing being shown representatively for clarity.
Figure 10:
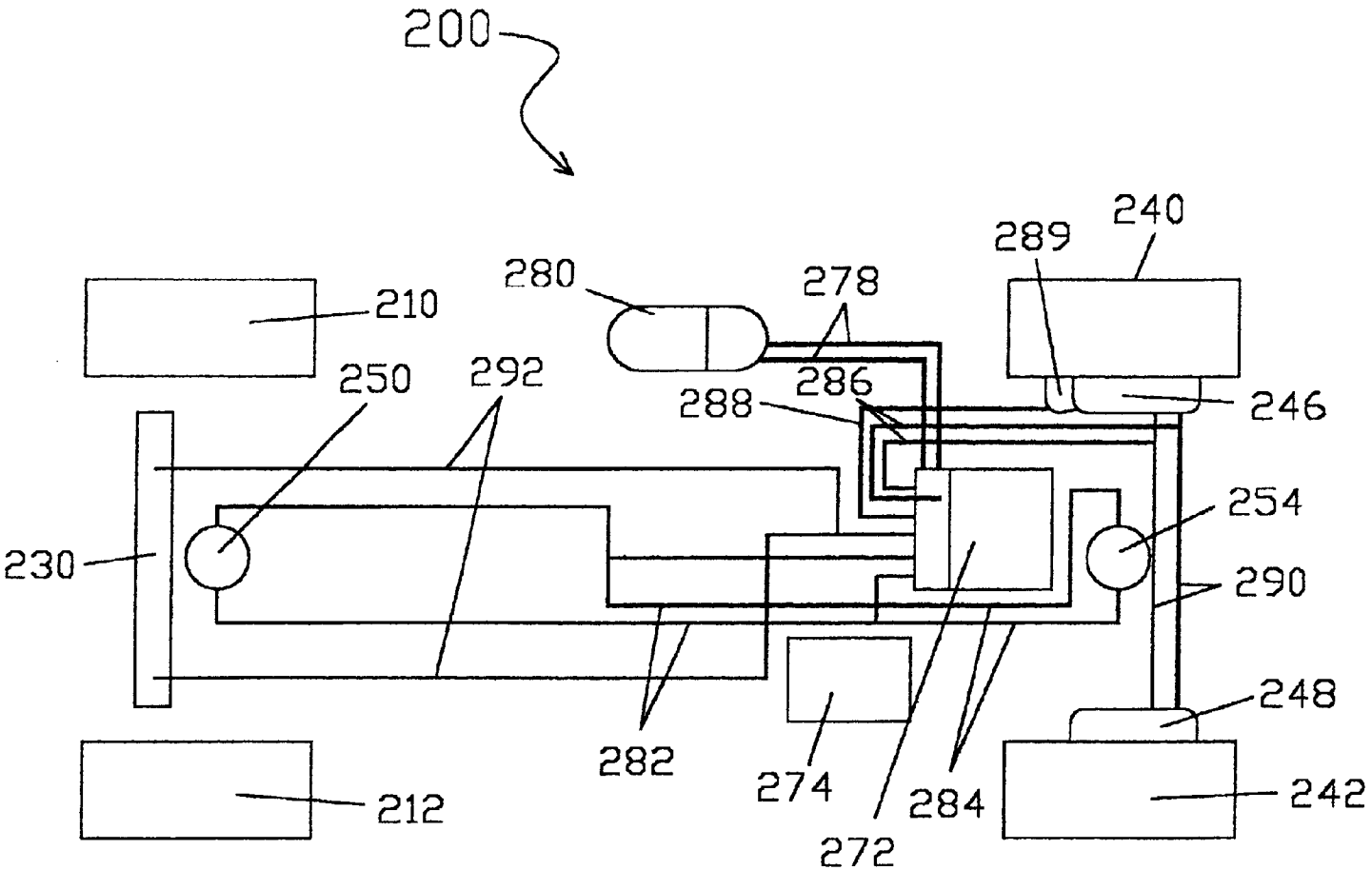
FIG. 10 is a schematic of an exemplary embodiment of the powered hydraulic system.

An additional exemplary embodiment of the apparatus 200 is shown in FIGS. 8-14 to include a powered hydraulic system for operating the lift assemblies, steering the apparatus, and driving the rear wheels. Selected components of the hydraulic system are shown representatively in FIG. 8, with more detail shown in FIG. 9. FIG. 10 is a schematic depiction of the powered hydraulic system.

As shown in FIG. 9, the first wheel assembly includes two wheels 210,212 on an axle structure 214. The first wheel is pivotably attached to the axle structure on a pivot member 216, the pivot member pivoting about a pivot pin 218. Similarly, the second wheel is pivotably attached to the axle structure on a pivot member 220, this pivot member pivoting about a pivot pin 222.

In embodiments of the type shown in FIG. 9, a tie-rod 224 is attached to the first wheel pivot member 226 on a pivot pin 226 and to the second wheel pivot member on a pivot pin 228. A double-acting hydraulic cylinder 230, has an extendable rod 232. The rod's exposed end is attached to the second wheel pivot member 220 on a pivot pin 234. A fixed extension member 236 extends from the axle structure 214 and attaches to the hydraulic cylinder 230 on a pin 238. The travel of the rod 232 is positioned and sized such that a longer extension of the rod moves the second wheel pivot member 220 and simultaneously pulls the tie-rod 224, and the first wheel pivot member 216, such that both wheels are steer-turned, i.e. turned in steering fashion, to the left. Conversely, the retraction of the rod pulls the second wheel pivot member 220 and simultaneously pushes the tie-rod 224 and the first wheel pivot member 216, such that both wheels are steer-turned to the right.

In other embodiments, the powered steering assembly is on the second wheel assembly wheels.

Embodiments of the kind shown in FIG. 9, include a second wheel assembly with two wheels 240,242 and an axle structure 244. Each wheel has a hydraulic drive assembly 246,248, including a hydraulic wheel motor.

Figure 14:
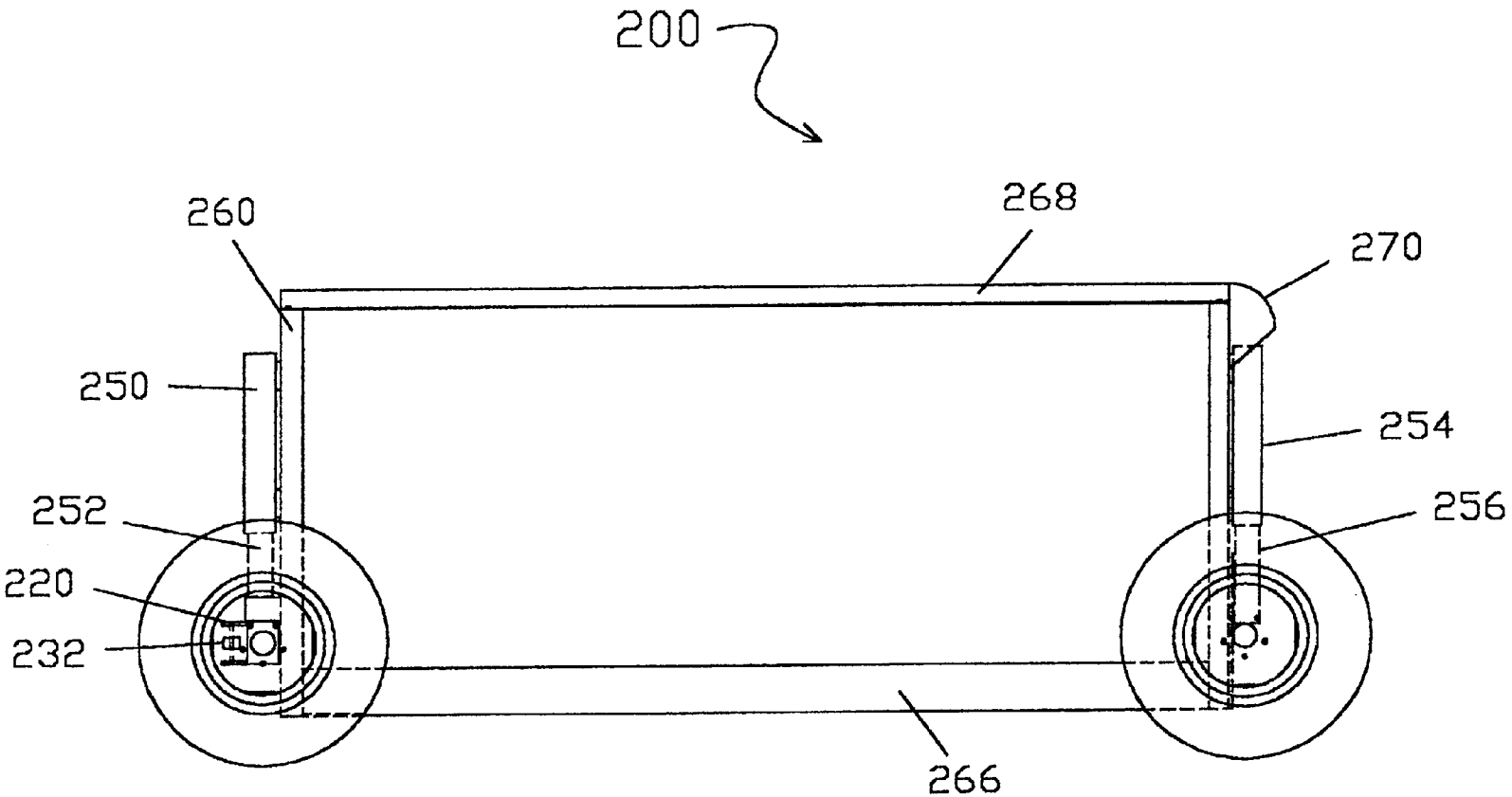
FIG. 14 is a side view of an exemplary embodiment of the present invention with the barrier removed and the elevator structure in a raised position.

Embodiments of the kind illustrated in FIG. 9, also include a first hydraulic lift assembly including a double-acting hydraulic cylinder 250. As shown in FIG. 14, the hydraulic cylinder has an extendable rod 252. The rod 252 is attached to the axle structure 214 while the hydraulic cylinder 250 is attached to the elevator structure 264 on the upright member 260. Such embodiments also include a second hydraulic lift assembly including a double-acting hydraulic cylinder 254 with an extendable rod 256. The rod 256 is attached to the axle structure 244 while the hydraulic cylinder 250 is attached to the elevator structure 264 on the upright member 262. The upright members 260,262 are connected by a cross member 268.

In other embodiments, the hydraulic cylinders in the lift assemblies are single-acting hydraulic cylinders, and the elevator structure lowers in response to gravity and the weight of the barrier 22 and elevator structure 264.

A frame 270 for positioning a controller 272 is attached to the elevator structure upright member 262, the controller having a control panel, a control valve assembly, and electric circuitry for operating the panel and control valve assembly. Electric batteries 274 are provided as a power source with conventional wiring 276 shown representatively on FIG. 9. Primary hydraulic lines 278 connect the controller to the electrically powered pump assembly 280. The pump assembly 280 and the batteries 274 are stored in an extension of the elevator structure 264.

Embodiments of the type shown in FIG. 9 and FIG. 10, also include hydraulic lines 282 for providing pressured fluid for the double-acting hydraulic cylinder 250 in the first lift assembly, and hydraulic lines 284 for the double-acting hydraulic cylinder 284 in the second lift assembly.

Similarly, a hydraulic line 286 provides fluid to the hydraulic drive assembly 246 on the first wheel 240 of the second wheel assembly, and also provides fluid to line 290 that delivers fluid to the hydraulic drive assembly 248 on the second wheel 242 of the second wheel assembly. Hydraulic line 288 provides fluid to a hydraulic brake 289 on the first wheel 240, and hydraulic lines 292 provide hydraulic fluid to the double-acting hydraulic cylinder 230 that provides hydraulic power for the steering.

Many of the hydraulic lines in FIG. 9 are shown in a substantially horizontal position for clarity. Persons of skill in the art, upon review of this disclosure will recognize that the present invention includes additional routing configurations in addition to the configuration shown.

Figure 11:
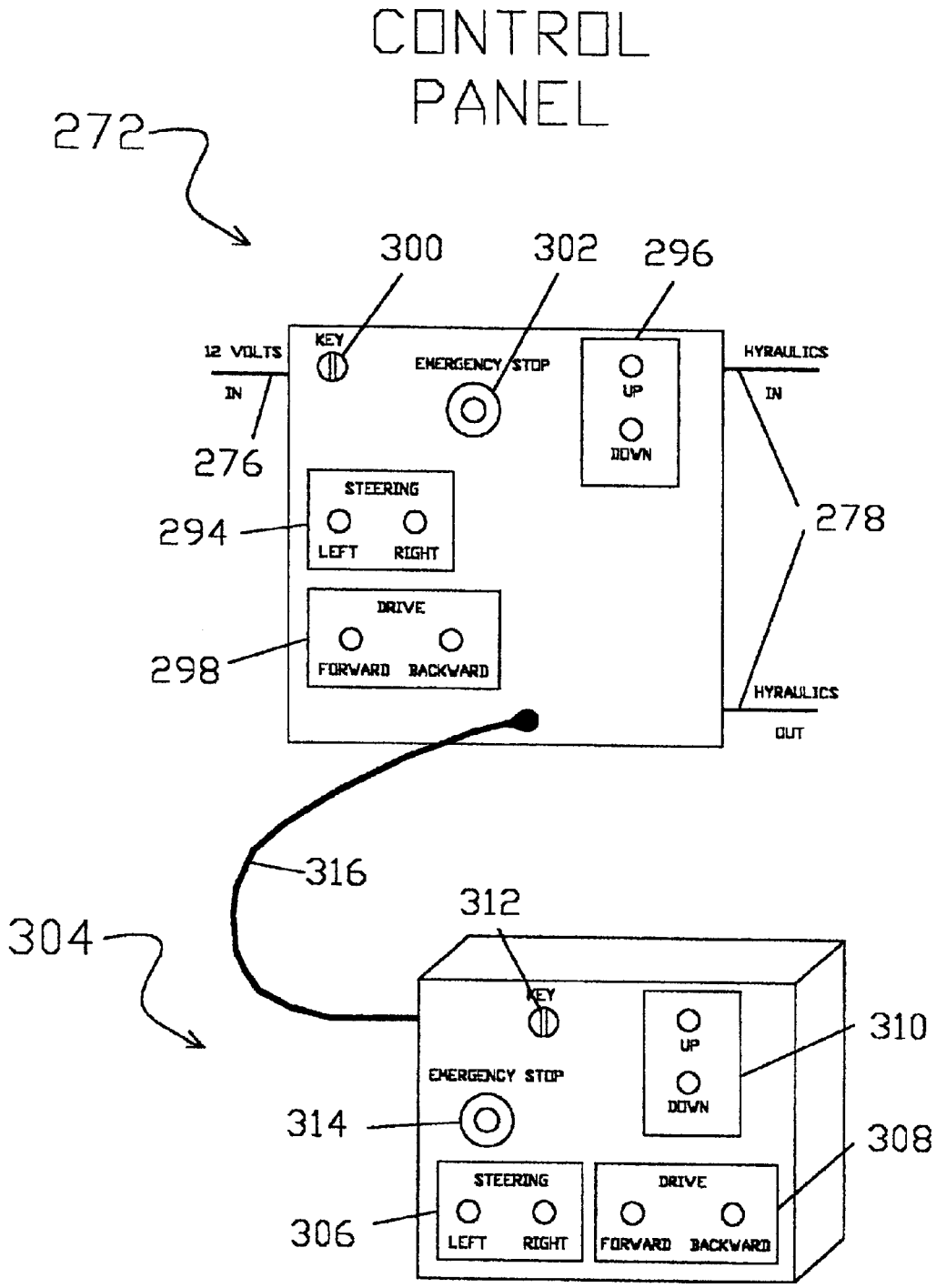
FIG. 11 is a front view of an exemplary embodiment of the controller control panel and a remote controller.

The functionality of the controller 272 as it operates the powered hydraulic system is shown in FIG. 11. Steering controls 294 cooperate with the hydraulic cylinder 230 through conventional valving mechanisms in the controller 272, to turn the wheels 210,212 in the first wheel assembly left and right The steering controls 294 cause the rod 232 to extend for turning left and retract for turning right.

Figure 12:
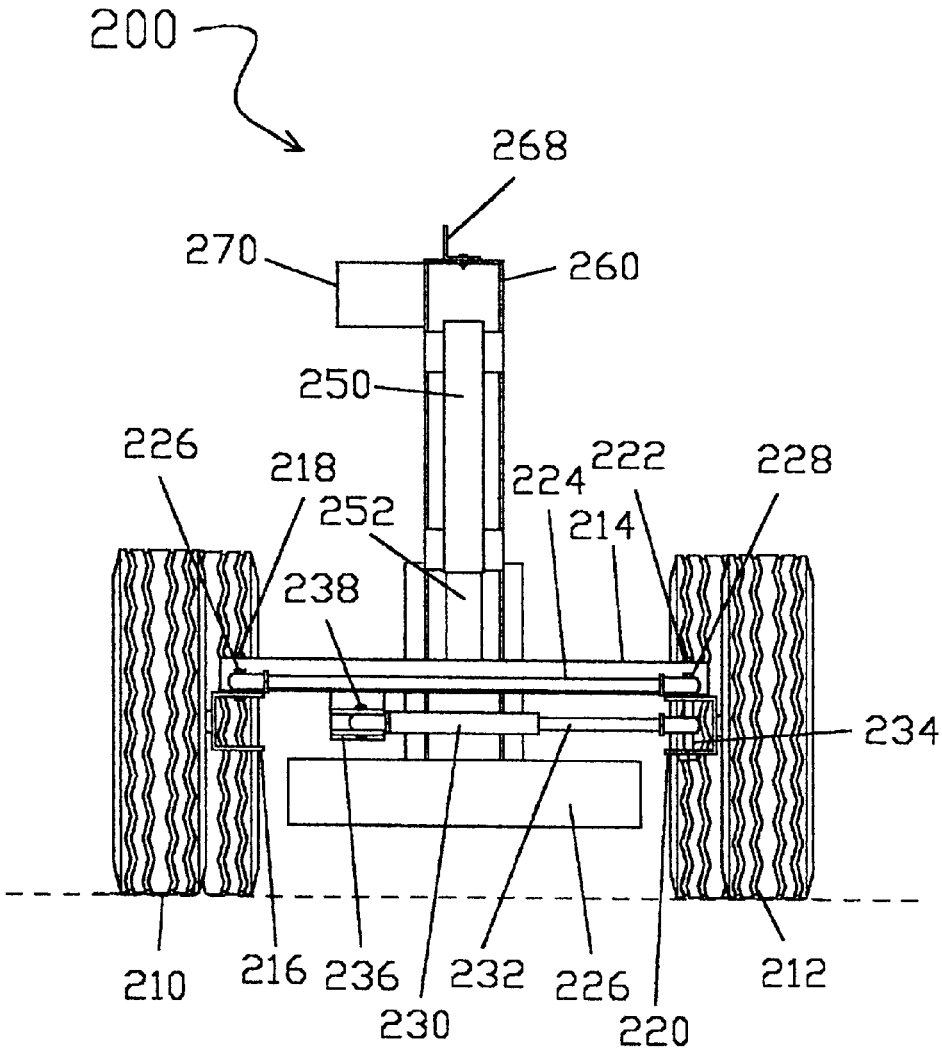
FIG. 12 is an end view of an exemplary embodiment of the present invention with the barrier removed and the elevator structure in a raised position.
Figure 13:
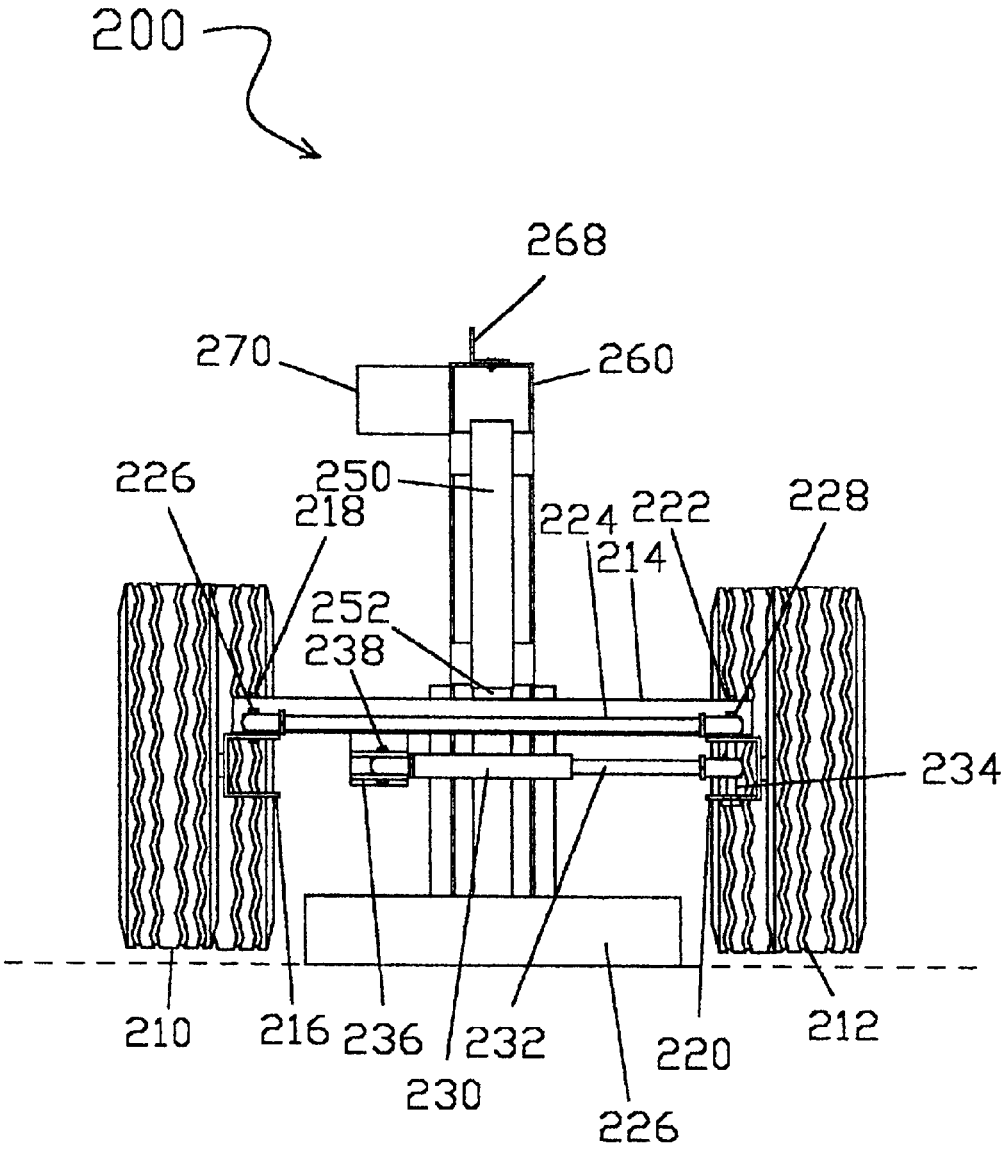
FIG. 13 is an end view of an exemplary embodiment of the present invention with the barrier removed and the elevator structure in the down position with the wheels hydraulically lifted off the ground.

Lift assembly controls 296 cooperate with the hydraulic cylinders 250,254 through valving mechanisms in the controller 272 to lift or lower the elevator structure 264. The lift assembly controls 296 cause the elevator structure to lift as the rods 252,256 extend, and to descend as the rods retract. The raised elevator structure position is depicted in FIG. 12 and the lowered elevator structure position is depicted in FIG. 13.

Driving controls 298 cooperate with the hydraulic drive assemblies in the second wheel assembly wheels 240,242 through valving mechanisms in the controller 272 to rotate such wheels, in rolling fashion, in a forward or reverse direction. In some embodiments, the wheels stop rolling automatically when the driving controls cease to be pressed. In other embodiments, the wheels free-wheel after the driving controls cease to force rolling. The exemplary embodiment shown in FIG. 9 and FIG. 11 include an emergency stop control 302 that cooperates with the hydraulic brake 289 in wheel 240 through valving mechanisms in the controller 272 to brake the wheel. In other embodiments, a conventional spring assembly in a brake is biased to apply the brake when the hydraulic fluid flow to the hydraulic driving assemblies 246,248 ceases.

Persons of skill in the art will recognize, upon review of the present disclosure, that various conventional hydraulic valving mechanisms are available that route hydraulic fluid as necessary for the performance of multiple functions such as those described in exemplary embodiments herein.

As shown in FIG. 11, this exemplary embodiment 200 has a controller 272 with a keyed on-off switch 300, for preventing unauthorized use of the hydraulic system controls.

In some embodiments of the kind shown in FIG. 11, the apparatus 200 includes a remote controller 304 having controls analogous to those of the attached controller 272, including steering controls 306, driving controls 308, lift assembly controls 310, emergency stop controls 314, and keyed access control 312. The remote controller 304 is connected to the controller 272 through cable 314.

In other embodiments, the controller 272 is detachable for storage apart from the barrier and remaining apparatus.

Through the use of the controller 272 or remote controller 304, the operator maneuvers the apparatus 200 into a desired location, either standing alone, in rows, or in staggered patterns that slow, but do not prevent automotive traffic. Once the apparatus is so positioned, the operator manipulates the lift assembly controls 296,310 to lower the elevator structure 264 to the lower position on the surface 21. If desired, the operator can raise the wheels from the surface, as shown in FIG. 13.

In some embodiments, the first wheel assembly has the hydraulic driving assemblies, in lieu of, or along with the second wheel assembly.

In some embodiments, the powered hydraulic system for steering, lifting, driving, and/or braking is replaced with a powered electrical system for steering, lifting, driving and/or braking.

In some embodiments, the electric batteries, as a source of power for the pump assembly 280 is replaced by an internal combustion engine.

With respect to the above description then, it is to be realized that the optimum material and dimensional relationships for the parts of the apparatus, as described in the foregoing exemplary embodiments, will include variations in size, materials, shape, and form, which will occur to those skilled in the art upon review of the present disclosure.

It will be understood from the foregoing description that various modifications and changes may be made, and in fact will be made, in the exemplary embodiments of the present invention without departing from its true spirit. The descriptions in this specification are for purposes of illustration only and are not to be construed in a limiting sense. The scope of the present invention is limited only by the language of the following claims.

What is claimed is:

1. An apparatus for transporting and positioning a barrier on a surface, the barrier having a first end, second end, a front side, a rear side, a top portion, and a bottom portion having a lower surface, the bottom portion being substantially wider than the top portion when viewed from the barrier first and second ends, the apparatus comprising:

an elevator adapted to receive the barrier, the elevator having a base, the barrier bottom portion lower surface being positioned on the base, a first end and a second end, a first upright member having a top, a second upright member having a top, and a connection member for connecting the first upright member top and the second upright member top, the first upright member having a width substantially the same as or less than the barrier top portion first end, the second upright member having a width substantially the same as or less than the barrier top portion second end, and the connection member having a width substantially the same as or less than the barrier top portion, the first and second upright members and the connection member being positioned proximate the barrier first and second ends and top portion, respectively, such that the barrier front side and the barrier rear side are viewable without substantial obstruction from the first upright member, second upright member and the connection member;

a first wheel assembly having at least two wheel members and a second wheel assembly having at least two wheel members; and a first lift assembly positioned proximate the elevator first end and cooperating with the first wheel assembly for raising and lowering the elevator first end, and a second lift assembly positioned proximate the elevator second end and cooperating with the second wheel assembly for raising and lowering the elevator second end, the barrier being raised and lowered with the elevator.

2. The apparatus of claim 1, wherein the elevator provides lateral support for the barrier.

3. The apparatus of claim 1, further comprising a powered hydraulic system for simultaneously operating the first and second lift assemblies, the first and second lift assemblies each comprising a hydraulic cylinder.

4. The apparatus of claim 3, wherein at least one of the first and second lift assemblies comprises a single acting hydraulic cylinder.

5. The apparatus of claim 3, wherein at least one of the first and second lift assemblies comprises a double acting hydraulic cylinder.

6. The apparatus of claim 5, wherein both the first and second lift assemblies comprise double acting hydraulic cylinders and the cylinders are positioned such that the first and second wheel assemblies are elevated above the surface after the elevator is lowered to the elevator's lowest position.

7. The apparatus of claim 3, further comprising a controller for operating the powered hydraulic system.

8. The apparatus of claim 7, wherein the controller is detachable.

9. The apparatus of claim 1, further comprising a powered system for simultaneously operating the first and second lift assemblies, the first and second lift assemblies each comprising a powered lift mechanism.

10. The apparatus of claim 9, further comprising a controller for operating the powered system.

11. The apparatus of claim 10, wherein the controller is detachable.

12. The apparatus of claim 9, further comprising a remote controller.

13. The apparatus of claim 1, wherein the first lift assembly comprises a first manual jack and the second lift assembly comprises a second manual jack.

14. The apparatus of claim 13, wherein the first and second manual jacks are positioned such that the first and second wheel assemblies are elevated above the surface after the elevator is lowered to the elevator's lowest position.

15. The apparatus of claim 1, wherein the first lift assembly comprises a first hydraulic jack and the second lift assembly comprises a second hydraulic jack.

16. The apparatus of claim 15, wherein the first and second hydraulic jacks are in hydraulic communication for simultaneous lifting.

17. The apparatus of claim 1, further comprising a steering assembly for turning the apparatus.

18. The apparatus of claim 17, wherein the steering assembly comprises a powered hydraulic system having a double-acting hydraulic cylinder, the cylinder having a rod, and a steering linkage assembly for linking the hydraulic cylinder to one of the first wheel assembly wheel members and linking the one wheel member to the other first wheel assembly wheel member for simultaneous steer-turning in response to extension and retraction of the rod from and into the hydraulic cylinder.

19. The apparatus of claim 17, wherein the steering assembly comprises:

a pivot member for each first wheel assembly wheel member, each wheel member steer-turning in response to movement of the pivot member;

a shaft member, the handle member being attached to the first wheel assembly for pivoting; and a link member for linking the handle member and wheel pivot members, such that both wheel member pivot arms move in response to pivoting motion of the shaft.

20. The apparatus of claim 1, further comprising a powered driving assembly for driving the apparatus.

21. The apparatus of claim 1, further comprising a powered driving assembly for driving the apparatus by rotating at least one of the second wheel assembly wheel members.

22. The apparatus of claim 21, wherein the driving assembly comprises a powered hydraulic system having a hydraulic driving assembly on the at least one wheel member.

23. The apparatus of claim 22, further comprising a hydraulic brake.

24. The apparatus of claim 1, further comprising a brake.

25. An apparatus for transporting and positioning a barrier on a surface, the barrier having a first end, second end, a front side, a rear side, a top portion, and a bottom portion having a lower surface, the bottom portion being substantially wider than the top portion when viewed from the barrier first and second ends, the apparatus comprising:

an elevator adapted to receive the barrier, the elevator having a base, the barrier bottom portion lower surface being positioned on the base, a first end and a second end, a first upright member having a top, a second upright member having a top, and a connection member for connecting the first upright member top and the second upright member top, the first upright member having a width substantially the same as or less than the barrier too portion first end, the second upright member having a width substantially the same as or less than the barrier top portion second end, and the connection member having a width substantially the same as or less than the barrier top portion, the first and second upright members and the connection member being positioned proximate the barrier first and second ends and top portion, respectively, such that the barrier front side and the barrier rear side are viewable without substantial obstruction from the first upright member, second upright member and the connection member;

a first wheel assembly having at least two wheel members and a second wheel assembly having at least two wheel members, the first wheel assembly positioned proximate the elevator first end, the second wheel assembly positioned proximate the elevator second end; and elevating means for raising and lowering the elevator with respect to the first and second wheel assemblies, the barrier being raised and lowered with the elevator.

26. The apparatus of claim 25, wherein the elevating means comprises a first manual jack proximate the first wheel assembly and a second manual jack proximate the second wheel assembly.

27. The apparatus of claim 25, wherein the elevating means comprises a first hydraulic jack proximate the first wheel assembly and a second hydraulic jack proximate the second wheel assembly.

28. The apparatus of claim 25, wherein the elevating means comprises a powered hydraulic system comprising a first hydraulic cylinder proximate the first wheel assembly and a second hydraulic cylinder proximate the second wheel assembly.

29. The apparatus of claim 25, wherein the elevating means comprises a powered system comprising a first powered lifting mechanism proximate the first wheel assembly and a second powered lifting mechanism proximate the second wheel assembly.

30. The apparatus of claim 25, further comprising means for driving the apparatus.

31. The apparatus of claim 25, further comprising means for steering the apparatus.

32. The apparatus of claim 25, further comprising means for braking the apparatus.

33. An apparatus for transporting and positioning a barrier on a surface, the barrier having a first end, second end, a front side, a rear side, a top portion, and a bottom portion having a lower surface, the bottom portion being substantially wider than the top portion when viewed from the barrier first and second ends, the apparatus comprising:

an elevator adapted to receive the barrier, the elevator having a base, the barrier bottom portion lower surface being positioned on the base, a first end and a second end, a first upright member having a top, a second upright member having a top, and a connection member for connecting the first upright member top and the second upright member top, the first upright member having a width substantially the same as or less than the barrier top portion first end, the second upright member having a width substantially the same as or less than the barrier top portion second end, and the connection member having a width substantially the same as or less than the barrier top Portion, the first and second upright members and the connection member being positioned proximate the barrier first and second ends and top portion, respectively, such that the barrier front side and the barrier rear side are viewable without substantial obstruction from the first upright member, second upright member and the connection member;

a first wheel assembly having at least two wheel members and a second wheel assembly having at least two wheel members; and a first lift assembly positioned proximate the elevator first end and cooperating with the first wheel assembly for raising and lowering the elevator first end, and a second lift assembly positioned proximate the elevator second end and cooperating with the second wheel assembly for raising and lowering the elevator second end, the barrier being raised and lowered with the elevator;

and further wherein the elevator provides lateral support for the barrier; and the apparatus further comprises:

a powered hydraulic system for simultaneously operating the first and second lift assemblies, the first and second lift assemblies each comprising a double-acting hydraulic cylinder, the cylinders being positioned such that the first and second wheel assemblies are elevated above the surface after the elevator is lowered to the elevator's lowest position;

a controller for operating the powered hydraulic system;

a powered steering assembly for turning the first wheel assembly wheel members, the steering assembly being powered by the powered hydraulic system; and a powered driving assembly for turning the second wheel assembly wheel members, the driving assembly being powered by the powered hydraulic system.

* * * * *